United States Patent [19]

Marks

[11] 4,318,425

[45] Mar. 9, 1982

[54] REFRIGERANT FLOW REVERSING VALVE

[75] Inventor: Robert T. Marks, Columbus, Ohio

[73] Assignee: Ranco Incorporated, Columbus, Ohio

[21] Appl. No.: 88,567

[22] Filed: Oct. 26, 1979

[51] Int. Cl.[3] ..... F16K 11/07

[52] U.S. Cl. ..... 137/625.43; 137/625.66; 251/368; 62/324.6

[58] Field of Search ..... 137/625.29, 625.43, 137/625.66; 251/368; 62/324 R

[56] References Cited

U.S. PATENT DOCUMENTS

| | | | |
|---|---|---|---|
| 2,927,606 | 3/1960 | Matchett, Jr. et al. . | |
| 2,969,655 | 1/1961 | Salter . | |
| 2,976,701 | 3/1961 | Greenawalt . | |
| 2,983,286 | 5/1962 | Greenawalt et al. . | |
| 3,039,491 | 6/1962 | Raney . | |
| 3,056,574 | 10/1962 | Greenawalt . | |
| 3,680,788 | 8/1972 | Cox | 251/368 |
| 3,897,043 | 7/1975 | McBain et al. | 251/368 X |
| 4,025,050 | 5/1977 | Manki et al. | 251/368 X |
| 4,213,483 | 7/1980 | Bauer | 137/625.29 |

OTHER PUBLICATIONS

*Handbook of Adhesive Bonding,* Charles V. Cagle, McGraw-Hill Book Co., 1973, pp. 19-17 thru 19-20.

*Primary Examiner*—Arnold Rosenthal

*Attorney, Agent, or Firm*—Watts, Hoffmann, Fisher & Heinke Co.

[57] ABSTRACT

A refrigeration system including a refrigerant flow reversing valve. The flow reversing valve includes a valve housing providing a chamber communicating with a refrigerant compressor discharge via a first port and a bearing surface with second, third and fourth ports opening into it, the second port communicating with the compressor inlet. A valving member is disposed on the surface for sliding movement to communicate, respectively, the first and fourth and second and third ports when in one position and to communicate, respectively, the first and third and second and fourth ports in a second position. The valving member is formed by a rigid plastic body defining a cavity by which the second port is communicated with the respective third and fourth ports and a face surrounding the cavity extending generally parallel to the bearing surface. A thin sheet of polytetrafluoroethylene is interposed between the valving body face and the bearing surface to enable low friction movement of the valving member between its positions. The sheet and valving body face are mechanically attached to each other.

13 Claims, 4 Drawing Figures

REFRIGERANT FLOW REVERSING VALVE

BACKGROUND OF THE INVENTION

1. Field of the Invention

The present invention relates to refrigeration systems and more particularly to refrigeration systems having refrigerant flow reversing valves.

Flow reversing valves are commonly used in refrigeration systems employing a refrigerant compressor, a refrigerant condensing heat exchanger and a refrigerant evaporating heat exchanger. In a typical system gaseous refrigerant is compressed by the compressor and discharged to a refrigerant condensing heat exchanger in the form of a relatively high temperature, high pressure gas. Heat is transferred from the gas in the condensing heat exchanger to the ambient atmosphere causing the refrigerant to condense and pass from the heat exchanger in liquid form at relatively high pressure. Condensation of the refrigerant results in heating the ambient atmosphere by the condensing heat exchanger.

The liquid refrigerant next passes through an expansion device formed by a flow restriction and evaporates at a relatively lower pressure in the refrigerant evaporating heat exchanger. The heat required for evaporating the refrigerant is transferred to it from the atmosphere surrounding the evaporating heat exchanger thus effectively chilling the atmosphere. Refrigerant passing from the evaporating heat exchanger flows to the compressor inlet where the refrigeration cycle is begun again.

Where a refrigeration system is used as a so-called heat pump, the direction of flow of the refrigerant is reversible so that a single heat exchanger serves to evaporate refrigerant and cool air in an air conditioned space during hot weather and to condense refrigerant and heat air in the space during cold weather.

The refrigerant flow is reversed by operation of a refrigerant flow reversing valve. Typical flow reversing valves have a first port communicating with the compressor discharge, a second port communicating with the compressor inlet and third and fourth ports communicating with the respective heat exchangers. The flow reversing valve contains a valve member which communicates refrigerant discharged from the compressor to one of the heat exchangers while communicating the outlet of the other heat exchanger to the compressor inlet. The valve member is actuated to reverse the direction of refrigerant flow through the heat exchangers.

Refrigerant flow reversing valves are also used in refrigeration systems for reversing the flow of refrigerant for relatively brief periods of time in order to direct hot refrigerant gas into the refrigerant evaporating heat exchangers in order to defrost the evaporating heat exchangers.

2. The Prior Art

Numerous refrigerant flow reversing valve configurations have been proposed by the prior art. Many of the proposed valves have not been commercially acceptable because of failure to meet performance criteria necessary for use in refrigeration systems. Refrigerant flow reversing valves must be capable of operating with relative ease under substantial differential pressures (i.e., the reversing valve member is constantly subjected to the differential pressure existing between the compressor inlet and discharge). Moreover, the valve member is constantly subjected to significant temperature gradients (i.e., the difference in temperature between the refrigerant exiting the evaporating heat exchanger and the refrigerant being delivered to the condensing heat exchanger). In addition, the valve member must permit no more than a minimal amount of leakage of the high pressure refrigerant to the compressor inlet to maximize the system operating efficiency, and the valve member must operate between its alternative positions quickly and reliably throughout a large number of cycles of operation.

One configuration of refrigerant flow reversing valve which has proved notably successful is disclosed by U.S. Pat. No. 3,056,574. This valve employs a generally cylindrical valve housing defining a chamber with a first port in one side communicating with the compressor discharge. A bearing surface is disposed in the chamber opposite the first port and second, third and fourth ports open in the chamber through the bearing surface. The second port communicates with the compressor intake and is located between the third and fourth ports.

A flow reversing valve member is slidably supported on the bearing surface for alternatively communicating the second port with the third port or the fourth port. When the second and third ports are in communication the first and fourth ports communicate so that refrigerant from the compressor discharge flows through the valve chamber via the first and fourth ports. When the second and fourth ports are communicated by the valve member the refrigerant from the compressor discharge flows through the valve chamber via the first and third ports.

The valve member is formed by a body defining a cavity through which the second and third or fourth ports are communicated. A valve body surface surrounding the cavity sealingly engages the bearing surfaces and slides on the bearing surface when the valve member changes position. The valve body is connected to an actuator for changing the valve position.

The valve member is urged with significant force against the bearing surface and when the valve member slides across the ports in the bearing surface the valve body surface tends to be subjected to impacts as the bearing crosses the edges of the ports as well as to abrasive wearing, resulting in refrigerant leakage and reduction of valve life. Consequently the valve body and bearing surface were constructed from metal, such as brass, and lapped to assure smooth and intimate face contact between them.

Attempts were made to reduce the cost of refrigerant reversing valves by forming the valve body of a rigid relatively low friction plastic material. A valve constructed in this manner is disclosed by U.S. Pat. No. 2,976,701. Valve bodies constructed from fiber reinforced nylon had requisite strength, but exhibited undue wearing of the valve body faces. Valve bodies constructed from polytetrafluoroethylene (for example, a material sold under the trademark Teflon) exhibited satisfactory wear and friction characteristics but were not structurally capable of use in the environment because of the temperature and pressures encountered.

A valve body constructed from drawn metal cups supporting a polytetrafluoroethylene valve body face is disclosed by U.S. Pat. No. 3,032,312. This construction has proved quite successful in that the drawn metal cups are rigid and structurally strong and form a smoothly contoured cavity for directing refrigerant flow. The polytetrafluoroethylene valve body face is formed by an endless band of material which is grasped and supported by the valve body cups. The face thus provides low friction sliding engagement between the valve body and the bearing surface without structurally weakening the valve body.

While this valve body construction has been successfully used in refrigerant flow reversing applications, constructing and assembling its components has created undesirably high production costs.

SUMMARY OF THE INVENTION

The present invention provides a new and improved refrigerant flow reversing valve having a composite valving member body which is of simple construction, relatively easily manufactured and which is capable of relatively long life in a refrigerant flow reversing valve environment.

A preferred refrigerant flow reversing valve constructed according to the invention includes a valve housing defining a chamber in which a bearing surface is disposed with refrigerant ports opening in the bearing surface and a valving member slidably disposed on the bearing surface for selectively communicating desired ports. The valving member is formed from a rigid plastic body having an elongated face extending peripherally about the body, confronting and extending in generally parallel relation to the bearing surface, a smoothly contoured cavity opening at the valving body face, and a thin sheet of low friction plastic material interposed between the valving body face and the bearing surface and having an inner periphery surrounding the cavity opening. The valving body face and sheet are mechanically interlocked to prevent their separation.

In one embodiment the sheet of low friction material is of polytetrafluoroethylene with the side adjacent the valving body face defining minute irregular interstices throughout its area and with material forming the valving body face engaged in the interstics to form a mechanical interlock.

A preferred valving body includes a lip extending circumferentially about the valving body cavity and projecting toward the bearing surface. The lip engages the inner periphery of the sheet of low friction material to support the sheet and protect the juncture of the sheet and valving body face from separating forces.

A preferred valve body can also be formed with lips projecting from the valving body face toward the bearing surface along marginal valving body portions spaced apart in the direction of movement of the valving member. These lips engage and support the sheet to protect the juncture of the sheet and valving body face to minimize the possibility of the sheet peeling away from the valving body face.

Additional features and advantages of the invention will become apparent from the following detailed description of a preferred embodiment made with reference to the accompanying drawings which form part of the specification.

DESCRIPTION OF THE PREFERRED EMBODIMENT

Figure 1:
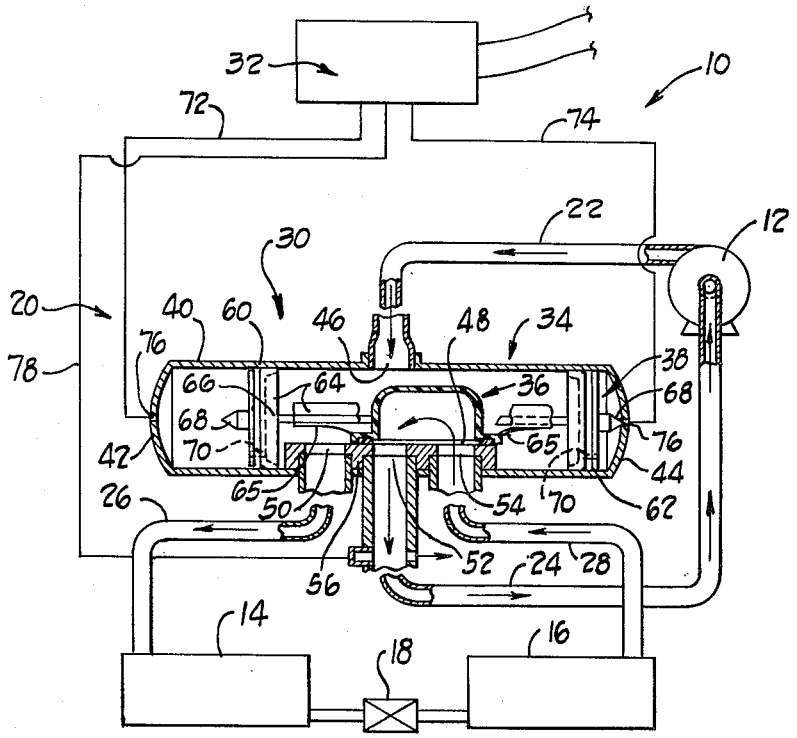
FIG. 1 is a schematic illustration of a refrigeration system employing a reversing valve constructed according to the invention with portions of the reversing valve shown in cross-section.

A refrigeration system 10 embodying the present invention is illustrated schematically by FIG. 1 of the drawings. The system 10 includes a conventional compressor 12, heat exchangers 14, 16 by which heat is transferred to or from refrigerant in the system 10, an expansion device 18 (such as a length of capillary tubing) in the flow path between the heat exchangers 14, 16 and a refrigerant flow reversing valve system (generally indicated by the reference character 20) interposed between the compressor 12 and the heat exchangers 14, 16 to reverse the direction of refrigerant flow through the heat exchangers.

The system 10 is a so-called "heat pump" refrigeration system in that it can be used for heating during cold weather and cooling during hot weather. In the illustrated system 10 the heat exchanger 14 functions to transfer heat between indoor air and refrigerant flowing through the system 10 while the heat exchanger 16 is in heat transfer relationship with outdoor air. The compressor 12 discharges high pressure, high temperature refrigerant to the heat exchangers via a discharge conduit 22 and the reversing valve system 20 while relatively low temperature, low pressure refrigerant is returned to the compressor via the valve system 20 and refrigerant inlet conduit 24.

When the system 10 is used to heat the indoor air the compressor 12 is operated to deliver high pressure, high temperature gaseous refrigerant from its discharge through the conduit 22 to the reversing valve system 20 and thence to the heat exchanger 14 via a refrigerant conduit 26. Heat is transferred from the refrigerant passing through the heat exchanger 14 causing heating of the indoor air and condensation of the refrigerant, at relatively high pressure, in the heat exchanger 14. Liquid refrigerant flows from the heat exchanger 14 through the expansion device 18 and undergoes a substantial pressure drop before passing into the heat exchanger 16. Heat from the outdoor atmospheric air around the heat exchanger 16 is transferred to the refrigerant flowing through that heat exchanger causing the refrigerant to evaporate. The relatively low pressure, low temperature gaseous refrigerant exiting the heat exchanger 16 is directed to the reversing valve system via a conduit 28 and thence to the compressor intake via the conduit 24, thus completing the refrigeration cycle.

When indoor air cooling is desired, the reversing valve system 20 is actuated so that the high pressure, high temperature refrigerant discharged from the compressor 12 passes through the reversing valve system 20 to the heat exchanger 16. The heat from the refrigerant in the heat exchanger 16 is transferred to the outside atmospheric air causing the refrigerant to condense in the heat exhanger 16, after which the liquid refrigerant flows through the expansion device 18 to the heat exchanger 14. Heat is transferred to the refrigerant in the heat exchanger 14 resulting in cooling of the indoor air and evaporation of the refrigerant. The low temperature, low pressure gaseous refrigerant flowing from the heat exchanger 14 returns to the compressor inlet via the conduit 26, the reversing valve system 20 and the inlet conduit 24.

The reversing valve system 20 includes a reversing valve assembly 30 communicating with the compressor discharge and inlet conduits 22, 24, respectively, and with the heat exchanger conduits 26, 28 and a pilot valve 32 for effecting actuation of the reversing valve assembly to reverse the direction of refrigerant flow from the valve assembly 30 through the heat exchangers 14, 16. The reversing valve assembly 30 is formed by a tubular valve housing 34 into which the conduits 22, 24, 26, 28 communicate, a valving member 36, and an actuator 38. The valving member 36 is movable between a first position in which it communicates the conduits 24, 26 and a second position for communicating the conduits 24, 28 by the actuator.

The valve housing 34 is preferably a metal cylinder 40 having caps 42, 44 hermetically joined to it across its opposite ends. A port 46 communicates the compressor discharge conduit 22 into the valve housing and is formed approximately mid-way along the length of the cylinder 40 to enable the high pressure, high temperature gaseous refrigerant to enter the valve housing. A bearing face 48 is disposed in the cylinder on the side opposite the port 46 and defines ports 50, 52, 54 which communicate respectively with the conduits 26, 24 and 28.

In the illustrated embodiment of the invention the bearing face 48 is planar and rectangular with the ports aligned along it in a row. The bearing face 48 is preferably formed on a bearing block 56 which is fixed in the cylinder 40 by welding or brazing. The ports 50, 52, 54 extend through the block 56 and the walls of the metal cylinder 40 with the ends of the conduits 26, 24, 28 hermetically joined to the valve housing and block. The port 52 communicating the compressor intake conduit 24 with the valve housing is preferably diametrically opposed to the port 46. The block 56 is formed of brass or some other suitably machinable material with the face 48 being ground so that it is extremely smooth and flat.

The actuator 38 slides the valving member 36 between its alternate operative positions and comprises opposed pistons 60, 62 which are joined by a rigid sheet metal valving member engaging bracket 64. The bracket 64 engages and transmits motion to the valving member 36 and carries leaf springs 65 which resiliently urge the valving member toward sealing engagement with the bearing face 48. The valving member 36 is subjected to significant differential refrigerant pressures when the system is operating and these pressures force the valving member against the bearing face 48. The leaf springs 65 maintain sealing engagement between the valving member and bearing surface when the refrigeration system is not in use. The bracket 64 is provided with relatively large area openings between the valving member 36 and each actuator piston to accommodate flow of refrigerant from the port 46 to either the port 50 (as illustrated by FIG. 1) or to the port 54 when the valving member position is changed.

Each of the pistons 60, 62 has a sealing ring 66 extending about its periphery and sealingly engaged with the interior wall of the cylinder, a needle valve element 68 projecting from the piston face towards the nearest end cap and a small bleed passage 70 extending through the piston face to enable limited fluid communication from one side of the piston to the other.

The preferred pilot valve 32 is electrically operated to control operation of the actuator 38 for governing the operating condition of the reversing valve. The pilot valve 32 is associated with pressure transmitting lines 72, 74 which communicate the pilot valve to control ports 76 formed, respectively, in the valve housing caps 42, 44. A third pressure transmitting line 78 communicates the pilot valve with low pressure refrigerant in the compressor inlet conduit 24.

The pilot valve 32 is schematically illustrated in FIG. 1 of the drawing with the details of the pilot valve structure being, for present purposes, identical to that disclosed by U.S. Pat. No. 3,032,312. The pilot valve functions to alternately communicate with the third pressure line 78 with the line 72 or the line 74 to create reversing valve operating differential pressure force on the actuator pistons.

In the condition of the reversing valve 30 illustrated by FIG. 1, it is assumed that the valving member 36 has been in the position illustrated for an appreciable period of time. In this condition of the reversing valve system 20, the pilot valve 32 communicates the pressure line 74 to the third pressure line 78 while blocking communication between the line 72 and either the line 74 or the line 78. Refrigerant discharged from the compressor 12 flows into the valve housing via the port 46 and is directed through the heat exchanger 14 via the port 50. Refrigerant flowing into the reversing valve from the heat exchanger 16 via the conduit 28 is communicated to the compressor inlet via the ports 54, 52 and the conduit 24. The pressure in the valve housing between the pistons is substantially at the level of the compressor discharge and, because of flow through the bleed passages 70 the compressor discharge pressure is exerted on both of the pistons. The needle valving element 68 on the piston 62 is aligned with and engaged in its control port 76 to prevent the escape of refrigerant from that end of the valve housing.

When the pilot valve 32 is operated to effect the reversal of the refrigerant flow through the system, the pressure lines 78 and 72 are abruptly communicated with each other while communication to either of those lines from the line 74 is blocked. This results in the pressure between the piston 60 and the housing cap 42 being reduced substantially to create a pressure imbalance across the actuator. The pistons and bracket are thus moved leftwardly, as viewed in FIG. 1, until the needle valve element 68 of the piston 60 engages the control port 76 to block the control line 72 and mechanically terminate movement of the actuator. At this juncture the bleed passages 70 permit the pressures across the pistons 60, 62 to equalize while the reversing valve remains in condition for communicating the ports 50 and 52 while enabling communication between the ports 46, 54.

When the condition of the reversing valve 30 is to be altered again, the pilot valve 32 communicates the lines 74 and 78 reducing the pressure the right side of the valve housing 34 to cause rightward movement of the valving member 36 until it returns to the position illustrated in FIG. 1.

Figure 2:
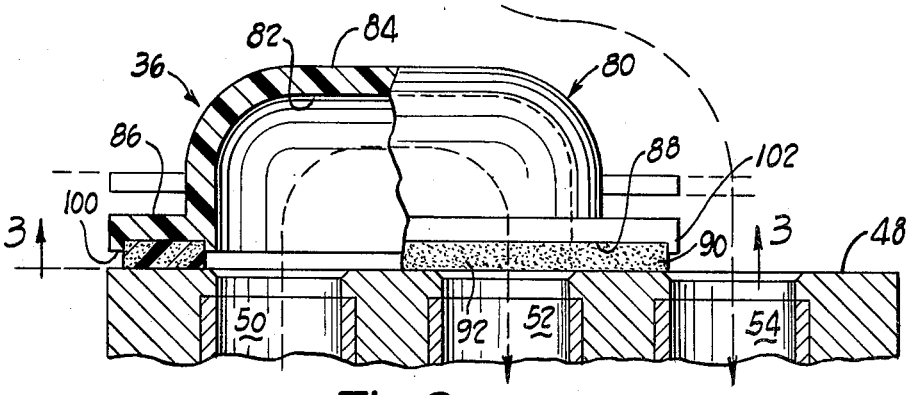
FIG. 2 is an enlarged view of part of the reversing valve illustrated in FIG. 1 with portions illustrated in elevation and portions in cross-section.
Figure 3:
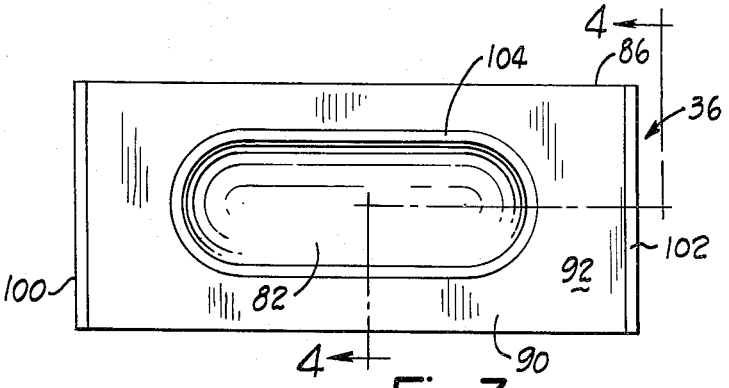
FIG. 3 is a view seen approximately from the plane indicated by the line 3—3 of FIG. 2.
Figure 4:
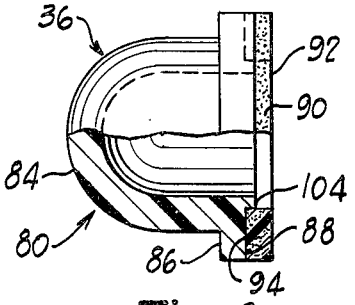
FIG. 4 is a view seen approximately from the planes of the lines 4—4 of FIG. 3.

Referring now to FIGS. 2-4 the valving member 36 is formed by a rigid plastic body 80 defining an elongated smoothly contoured internal cavity 82 whose width is at least as great as the widest of the ports 50, 52, 54 and whose length is sufficient to fully communicate the port 52 with either the port 50 or the port 54 depending upon the position of the body 80 (See FIG. 2).

The external surface 84 of the valving member is smoothly contoured to provide minimum flow impedance to the high pressure, high temperature gaseous refrigerant which flows into the valve housing via the port 46. The cavity 82 defines a generally elliptical opening in the body 80 which is surrounded by a peripheral flange 86 extending outwardly from the margins of the cavity 82. The flange 86 has a generally rectangular shape (see FIG. 3) and defines a face 88 which confronts the bearing face 48.

The body 80 can be made from injection molded glass fiber reinforced nylon but is preferably formed of a glass fiber reinforced two-stage phenolic molding compound having properties possessed by molding compounds known as FM 4004 or FM 4005 available from Fiberite Corporation, Winona, Minn. The phenolic molding compounds are preferable to the nylon in that they are less susceptible to warping after the injection molding process.

A thin sheet 90 of polytetrafluoroethylene plastic (TFE) is fixed to the flange face 88 to provide a valving member bearing surface 92 for sealing against the bearing face 48 and providing for low friction sliding movement of the valving member 36 between its positions. TFE is not structurally capable of sustaining the differential pressure forces and temperatures in the reversing valve environment and therefore cannot be used for construction of the valving member body itself. When used in sheet form attached to the valving member however, the TFE has been found structurally stable enough to function in the environment and, in fact, exhibits good sealing properties while minimizing sliding friction between the valve member and the bearing face 48. It has been found that TFE sheet thicknesses of less than about 0.1 inch should be used in order to assure that the TFE is not warped or extruded as a result of its exposure to high pressure, high temperature gaseous refrigerant in the valve housing.

When the valving member slides on the bearing face 48 the TFE bearing surface 92 moves across the ports 50, 52, 54 and tends to experience impacts from the edges of the ports. In order to assure adequate resiliency of the TFE sheet it has been found that the sheet should be at least 0.025 inches thick. This material thickness renders the sheet 90 sufficiently resilient to withstand the impacts over an extended number of cycles without significant damage to the sealing surface.

TFE is known as a difficult material to bond to other materials, particularly plastics. This is particularly true in an environment, such as that of a refrigerant reversing valve, in which the bond is exposed to relatively high temperatures, relatively large temperature gradients, substantial differential pressure forces, impact loads, and forces tending to peel the materials apart along their juncture as are present when the valving member slides between its position.

In accordance with the invention the TFE sheet 90 is mechanically bound to the valving member body in a way which strongly resists the separating forces present and in the environment. The TFE surface 94 engaging the valving body face 88 is provided with minute interstices into which material from the face 88 is flowed and hardened, or cured, to mechanically secure the sheet 90 in place. In addition, the material flowing into the interstices substantially completely displaces ambient atmosphere from them so that air or gas pockets are substantially eliminated and "suction" or vacuum bonding forces are created for resisting mechanical separation of the sheet and body. The preferred method of treating the TFE surface 94 to provide the necessary interstices is by chemical etching.

TFE sheet material which has been stamped or otherwise sized to fit on the face 88 is cleaned with a solvent, such as acetone, and then abraded lightly with a 200 grit sandpaper. The stamped sheet is then immersed from 15 to 90 seconds in a room temperature solution formed from the following ingredients: 1 liter of tetrahydrofuran, 128 grams of naphthalene, and 46 grams of sodium metal (in the form of chips, wire or ribbon). After immersion in the etching solution the sheet is rinsed with distilled water and dried at temperatures of from 110° F. to 120° F.

This procedure results in a TFE surface formed by microscopic nodules, or projections, which form the interstices. These nodules are effective to allow wetting of the surface of the TFE sheet and thus material from the valving body face 88 can flow into the interstices and be cured in place to mechanically interlock the valving body and sheet together.

After the etching process the sheet 90 is joined to the valve body face 88. One technique for joining the sheet and face employs use of a two component epoxy bonding material which is mixed appropriately and spread on the valving body face 88. The TFE sheet is then applied to the face in a desired location, clamped in place in full face contact with the face and the assembly is cured under appropriate elevated temperature conditions. After curing, the sheet bearing surface 92 is machined for use. The bonding material is strongly adhered to the valving member flange and forms part of the face 88. A preferred bonding material is epoxy No. NP428 manufactured by Miracle Adhesive Corp., Belmore N.Y. Another suitable adhesive is Bonding Kit No. CP84 available from Chemplast Inc., Wayne, N.Y.

If the valving member is assembled using bonding material the valving body may be prepared for the bonding process by heat treating the body in 350° F. oil for three hours; degreasing; milling the surface 88 and, degreasing the body again before applying the bonding material. The milling operation assures flatness of the body face 88; but if the surface 88 is substantially planar after heat treating the milling operation may be omitted. Heat treating stress relieves the plastic body material and need not be carried out if the body does not have appreciable internal stresses.

The bearing surface 92 can be lapped to provide the finished bearing surface, although alternatively the surface can be ground to the desired finish or subjected to a sciving operation which produces a surface finish of about 8 microinches, rms.

The sheet and valving body can also be joined during the valving body molding process by placing the etched sheet in the injection mold and injecting the valving body material into the mold. The valving body material wets the etched TFE member to form a mechanical interlock.

The direct molding process of joining the sheet and valving body is less complicated and produces satisfactory results so that this procedure is preferred. After molding the body and sheet together the bearing surface 92 is lapped, ground or skived in order to produce a planar bearing surface having a finish of around 8 microinches, rms. If the valving member body has warped after molding so that the sheet 90 is not substantially planar, the valving member assembly is milled so that the bearing surface 92 formed by the sheet 90 is substantially planar before the surface finishing operation is carried out.

Further in accordance with the invention the valving body 80 is provided with sheet engaging lips which project from the valving body surface 88 partially along the edges of the TFE sheet 90 to further secure the sheet in place. As illustrated by FIGS. 2–4, lips 100, 102 are formed at opposite longitudinal ends of the valving body flange 86 while a lip 104 extends around the periphery of the cavity 82 and projects from the face 88. The lips all extend across the bonded interface between the TFE sheet 90 and the valve body face 88 to further protect the interface against any tendency of the sheet to peel as a result of sliding of the valve member on the face 48. At the same time the lips act as structural reinforcement tending to limit the shearing stresses applied to the interface as the valve body is slid.

While a single embodiment of the present invention has been illustrated and described in considerable detail the present invention is not to be considered limited to the precise construction shown. Various adaptations, modifications and uses of the invention may become apparent to those skilled in the art to which the invention relates and the intention is to cover hereby all such adaptations modifications and uses which come within the scope or spirit of the appended claims.

What is claimed is:

1. A refrigerant flow reversing valve comprising:

(a) a valve housing defining a chamber for communicating with a refrigerant compressor;

(b) a first refrigerant port communicating the chamber with a compressor discharge;

(c) a bearing face supported in said chamber spaced from said first port;

(d) second, third and fourth ports opening into said chamber through said bearing face, said second port communicable with the compressor intake;

(d) a valving member slidably disposed on said bearing face for movement between a first position wherein said second and third ports are communicated with each other via said valving member and said first and fourth ports are communicated with each other and a second position wherein said second and fourth ports are communicated with each other via said valving member and said first and third ports are communicated with each other; and (f) actuator means for moving said valving member between said first and second positions;

(g) said valving member comprising:

(i) a rigid plastic valve body defining an elongated face extending peripherally about said valve body confronting said bearing face and extending generally parallel to said bearing face;

(ii) a smoothly contoured cavity opening into said valve body face, the opening of said cavity in said face having a width which is at least as great as the maximum diametrical extent of the largest of said second, third and fourth ports and having a length sufficient to fully communicate said second and third ports and said second and fourth ports;

(iii) a thin sheet of polytetraflouroethylene interposed between said face and said bearing surface and defining an inner periphery extending about the opening of said cavity in said face, said sheet having one side engaged with said valve body face and its opposite side in low friction sealing engagement with said bearing surface;

(iv) means mechanically interlocking said valve body face and said one side of said sheet, said interlocking means including microscopic nodules formed across said one side of said sheet; and, (v) said valve body face defining marginal regions spaced apart in the direction of movement of said valve body between said positions, said marginal regions including lips projecting toward said bearing face and engaging said polytetrafluoroethylene sheet.

2. The valve claimed in claim 1 wherein said sheet is between 0.025 and 0.1 inches thick.

3. A refrigerant flow reversing valve comprising:

(a) a tubular valve housing;

(b) structure for communicating high pressure relatively high temperature refrigerant into said valve housing from a refrigerant compressor discharge;

(c) a bearing face in said housing in which are defined three refrigerant flow ports, one of which communicates relatively low pressure, low temperature gaseous refrigerant to the compressor inlet;

(d) a valving member supported on said bearing face for sliding motion relative to said ports; and (e) an actuator for shifting said valving member along said bearing face to communicate said one port with one or the other of the other two ports, (f) said valving member comprising:

(i) a rigid plastic valving body defining an internal cavity having a width at least as great as the diametrical extent of the largest port in said bearing face and a length sufficiently long to enable communication of said one port and either one of the other two ports via said cavity while enabling the third port to communicate with the interior of said valve housing;

(ii) a valving body face extending peripherally about said cavity and confronting said bearing face, said cavity defining a generally elliptical opening in said valving body face;

(iii) a thin sheet of low friction plastic material interposed between said valving body face and said bearing face to facilitate sliding motion of said valving member on said bearing face;

(iv) a lip extending about at least part of said opening, engaging said sheet and overlying the juncture between said sheet and said valving body; and, (v) connecting structure between said sheet of low friction material and said valving body, said connecting structure formed in part by the side of said sheet of material facing the valving body, said side of said sheet defined at least in part by a microscopic interstices by which the valving body and the sheet are mechanically interconnected.

4. The reversing valve claimed in claim 3 wherein said interstices are defined by projecting nodules of said sheet material and said connecting structure further comprises material continuous with said valving element material extending into said interstices.

5. The valve claimed in claim 4 wherein said connecting structure material is a bonding material attached to the material forming said valving element.

6. The valve claimed in claim 3 wherein said valving body face is defined on a flange extending outwardly from the opening of said cavity in said face and further including lips projecting from marginal portions of said flange toward said bearing face, said lips engaging edges of said sheet and overlying the juncture of said sheet and face.

7. The valve claimed in claim 3 wherein said sheet is between 0.025 and 0.1 inches thick.

8. The valve claimed in claim 7 wherein said sheet defines a bearing surface engaged with said bearing face having a surface finish of about 8 microinches rms.

9. The valve claimed in claim 3 wherein said valving body is formed by a fiber reinforced molded phenolic resin material.

10. A refrigerant flow reversing valve comprising:

(a) a tubular valve housing;

(b) structure for delivering high temperature, high pressure refrigerant into said housing from a compressor discharge;

(c) a bearing face disposed in said valve housing, spaced from said structure and defining three spaced refrigerant ports one of which communicates with a refrigerant compressor intake;

(d) a valving member slidably disposed on said bearing face, said valving member comprising:

(i) a rigid plastic valving body defining an elongated cavity whose width is at least as great as the diametrical extent of the largest of said ports and having a length sufficient to communicate said one port with one of the remaining ports while enabling communication of the other port with the interior of said valve housing;

(ii) a valving body face disposed about said cavity, and extending parallely with respect to and confronting the bearing face;

(iii) a relatively thin sheet of low friction plastic material connected to said valving body face and interposed between said valving body face and said bearing face for enabling sliding of said valving member body with respect to said bearing face; and (iv) a lip extending about at least part of the opening of said cavity in said valving body face and overlying the juncture of said sheet and said valving body face.

11. The flow reversing valve claimed in claim 10 further comprising second lips extending from said valving body face at least along valving body peripheral portions spaced from said cavity in the directions of valving body sliding motion, said second lips extending beyond the juncture of said sheet and valving body face and engaging said sheet.

12. A refrigerant flow reversing valve comprising:

(a) a valve housing defining a chamber for communicating with a refrigerant compressor;

(b) a first refrigerant port communicating the chamber with a compressor discharge;

(c) a bearing face supported in said chamber spaced from said first port;

(d) second, third and fourth ports opening into said chamber through said bearing face, said second port communicable with the compressor intake;

(e) a valving member slidably disposed on said bearing face for movement between a first position wherein said second and third ports are communicated with each other via said valving member and said first and fourth ports are communicated with each other and a second position wherein said second and fourth ports are communicated with each other via said valving member and said first and third ports are communicated with each other; and (f) actuator means for moving said valving member between said first and second positions;

(g) said valving member comprising:

(i) a rigid plastic body defining an elongated face extending peripherally about said valve body confronting said bearing face and extending generally parallel to said bearing face;

(ii) a smoothly contoured cavity opening into said valve body face, the opening of said cavity in said face having a width which is at least as great as the maximum diametrical extend of the largest of said second, third and fourth ports and having a length sufficient to fully communicate said second and third ports and said second and fourth ports, said valve body defining a lip extending about the opening of said cavity and projecting from said valve body face toward said bearing surface;

(iii) a thin sheet of polytetrafluoroethylene interposed between said face and said bearing surface and defining an inner periphery extending about the opening of said cavity in said face and engaging said lip, said sheet having one side engaged with said valve body face and its opposite side in low friction sealing engagement with said bearing surface; and (iv) means mechanically interlocking said valve body face and said one side of said sheet, said interlocking means including microscopic nodules formed across said one side of said sheet.

13. The valve claimed in claim 12 wherein said valve body face defines marginal regions spaced apart in the direction of movement of said valve body between said positions, said marginal regions including lips projecting toward said bearing face and engaging said polytetrafluoroethylene sheet.

* * * * *